US008899931B2

(12) United States Patent
Nakaniwa et al.

(10) Patent No.: US 8,899,931 B2
(45) Date of Patent: Dec. 2, 2014

(54) IMPELLER, COMPRESSOR, AND METHOD FOR PRODUCING IMPELLER

(75) Inventors: Akihiro Nakaniwa, Takasago (JP); Yujiro Watanabe, Hiroshima (JP); Toyoaki Yasui, Hiroshima (JP); Kazuyoshi Miyagawa, Takasago (JP); Yuya Konno, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 679 days.

(21) Appl. No.: 13/124,729

(22) PCT Filed: Jan. 15, 2010

(86) PCT No.: PCT/JP2010/050401

§ 371 (c)(1),
(2), (4) Date: Apr. 18, 2011

(87) PCT Pub. No.: WO2010/090062

PCT Pub. Date: Aug. 12, 2010

(65) Prior Publication Data

US 2011/0200439 A1 Aug. 18, 2011

(30) Foreign Application Priority Data

Feb. 6, 2009 (JP) ..... 2009-025944

(51) Int. Cl.

| | |
|---|---|
| ***F01D 5/14*** | (2006.01) |
| ***F04D 29/28*** | (2006.01) |
| ***F04D 29/62*** | (2006.01) |
| ***F04D 29/02*** | (2006.01) |

(52) U.S. Cl.

CPC ..... *F04D 29/284* (2013.01); *F04D 29/624* (2013.01); *F04D 29/023* (2013.01)

USPC ..... 416/185

(58) Field of Classification Search

USPC ..... 416/182, 183, 185, 186 R

See application file for complete search history.

(56) References Cited

U.S. PATENT DOCUMENTS 5,964,398 A 10/1999 Kohno et al.
6,033,183 A * 3/2000 Genster ..... 416/186 R (Continued)

FOREIGN PATENT DOCUMENTS

JP 56-33188 4/1981
JP 5-149103 6/1993

(Continued)

OTHER PUBLICATIONS

International Search Report issued Feb. 16, 2010 in International (PCT) Application No. PCT/JP2010/050401.

(Continued)

*Primary Examiner* — Edward Look
*Assistant Examiner* — William Grigos
(74) *Attorney, Agent, or Firm* — Wenderoth, Lind & Ponack, L.L.P.

(57) ABSTRACT

A hub is supported rotatably about an axis of rotation, and the diameter thereof increases from upstream to downstream sides along a fluid flow. A plurality of impeller blades extend radially outward from an outer circumferential surface of the hub. A shroud is formed in a cylindrical shape whose diameter increases from the upstream to downstream sides along the fluid flow and joins outer circumferential ends of the plurality of impeller blades. The impeller blades are composed of upstream blade segments and downstream blade segments bonded at a bonding surface extending in a direction substantially perpendicular to the axis of rotation. The upstream blade segments are integral with at least a portion of the shroud, and the downstream blade segments are integral with at least a portion of the hub. This improves the reliability and performance of an impeller and a compressor.

7 Claims, 4 Drawing Sheets

(56) References Cited

U.S. PATENT DOCUMENTS

| | | | | |
|---|---|---|---|---|
| 2006/0280609 | A1* | 12/2006 | Ranz et al. | 416/182 |
| 2009/0311102 | A1* | 12/2009 | Poll | 416/182 |

FOREIGN PATENT DOCUMENTS

| | | | | |
|---|---|---|---|---|
| JP | 7-109997 | | 4/1995 | |
| JP | 2004-036444 | | 2/2004 | |
| JP | 2004-308647 | | 11/2004 | |
| JP | 2004308647 | A * | 11/2004 | F04D 29/22 |
| JP | 2005-146962 | | 6/2005 | |
| WO | WO 2008034492 | A1 * | 3/2008 | F03B 3/12 |

OTHER PUBLICATIONS

Chinese Office Action issued Mar. 19, 2013 in corresponding Chinese Patent Application No. 201080003067.0 with English translation.

Chinese Office Action issued Mar. 24, 2014 in corresponding Chinese Patent Application No. 201080003067.0 with English translation.

* cited by examiner

IMPELLER, COMPRESSOR, AND METHOD FOR PRODUCING IMPELLER

TECHNICAL FIELD

The present invention relates, particularly, to shrouded impellers suitable for use in centrifugal compressors and mixed flow compressors, compressors including such impellers, and methods for producing impellers.

BACKGROUND ART

Known impellers used for centrifugal compressors and mixed flow compressors typically include open impellers without a shroud and shrouded impellers with a shroud.

A shrouded impeller is known to be advantageous over an open impeller in that it has a high compression efficiency with, for example, a low flow loss because it has no gap between impeller blades and a casing accommodating the impeller.

On the other hand, a shrouded impeller has a problem in that it is less easily produced than an open impeller because it has a shroud.

Methods proposed for solving the problem described above include a method in which a hub and blades and a shroud are separately formed, and the blades and the shroud are bonded; a method in which a shrouded impeller is integrally formed by machining; and a method in which an impeller is formed as an inner segment and an outer segment, and the two segments are bonded (see, for example, Patent Literatures 1 and 2).

CITATION LIST

Patent Literature

PTL 1

Japanese Unexamined Patent Application, Publication No. 2004-036444

PTL 2

Japanese Unexamined Patent Application, Publication No. 2004-308647

SUMMARY OF INVENTION

Technical Problem

However, the method, described above, in which the blades and the shroud are bonded has a problem in that a bonding failure is likely to occur because the joints are inclined. Similarly, the method disclosed in Patent Literature 1 has a problem in that a bonding failure is likely to occur because the joint is inclined.

For example, if the method used for bonding is diffusion bonding, a bonding material disposed at the joints between the blades and the shroud might flow downward during the bonding process. This poses a problem in that a bonding failure is likely to occur in the upper regions of the joints because of insufficient bonding material.

Additionally, in the above method in which the blades and the shroud are bonded, a high stress occurs at part of the joints between the blades and the shroud when the shrouded impeller is rotated. This poses a problem in that the stress could break the joints between the blades and the shroud, thus possibly impairing the reliability of the shrouded impeller.

On the other hand, the method in which a shrouded impeller is integrally formed by machining has a problem in that the shrouded impeller has a lower performance than those fabricated by other methods because machining tools such as endmills have limited machining ranges.

Specifically, unremoved portions are left in the spaces between the hub and the shroud, that is, the spaces through which a fluid flows, because the machining range of the machining tool is limited by interference with the hub or the shroud. These unremoved portions disrupt the flow of the fluid flowing therearound, thus posing a problem in that the shrouded impeller has a lower performance than those fabricated by other methods that leave no unremoved portion.

An object of the present invention, which has been made to solve the above problems, is to provide an impeller, a compressor, and a method for producing an impeller that afford improved reliability and performance.

Solution to Problem

To achieve the above object, the present invention provides the following solutions.

An impeller according to a first aspect of the present invention includes a hub which is supported rotatably about an axis of rotation and whose diameter increases from upstream to downstream sides along a fluid flow, a plurality of impeller blades extending radially outward from an outer circumferential surface of the hub, and a shroud formed in a cylindrical shape whose diameter increases from the upstream to downstream sides along the fluid flow and joining outer circumferential ends of the plurality of impeller blades. The impeller blades are composed of upstream blade segments and downstream blade segments bonded at a bonding surface extending in a direction substantially perpendicular to the axis of rotation, the upstream blade segments are integral with at least a portion of the shroud, and the downstream blade segments are integral with at least a portion of the hub.

In this structure, because the upstream blade segments formed integrally with at least a portion of the shroud and the downstream blade segments formed integrally with at least a portion of the hub are bonded at the bonding surface, the impeller has smaller unremoved portions than an impeller fabricated by machining using a machining tool, thus inhibiting disruption of the fluid flow through the impeller.

That is, the above upstream blade segments and the above downstream blade segments have smaller unremoved portions than in the case where the entire impeller is integrally formed because they interfere with a machining tool over a narrower region. Accordingly, the impeller having the upstream blade segments and the downstream blade segments bonded at the bonding surface has smaller unremoved portions.

In addition, because the upstream blade segments are formed integrally with at least a portion of the shroud and the downstream blade segments are formed integrally with at least a portion of the hub, sufficient strength is ensured in regions where a high stress occurs as the impeller is rotated, thus preventing damage to the impeller.

Furthermore, the part composed of the upstream blade segments and at least a portion of the shroud and the part composed of the downstream blade segments and at least a portion of the hub can be fabricated with higher precision than in a method in which impeller blades and a shroud are bonded. As a result, the impeller having the two parts bonded can be fabricated with higher precision.

At the same time, because at least the upstream blade segments and the downstream blade segments are bonded at the bonding surface extending in a direction substantially perpendicular to the axis of rotation, a bonding failure can be prevented at the bonding surface.

For example, if diffusion bonding is used, the downstream blade segments and the hub are placed with the bonding surface, described above, substantially horizontal before at least the upstream blade segments and the downstream blade segments are bonded, so that the bonding material used for bonding does not easily flow downward. In other words, the bonding material is present substantially uniformly over the entire bonding surface, thus preventing a bonding failure due to insufficient bonding material.

Here, extending in a direction substantially perpendicular to the axis of rotation means that, if the bonding surface is formed in a conical shape whose centerline coincides with the axis of rotation, the bonding surface may be inclined to such an extent that a melted bonding material does not flow downward when the axis of rotation is oriented substantially vertically.

In the first aspect of the present invention, preferably, the shroud is composed of an upstream shroud and a downstream shroud bonded at the bonding surface, the upstream blade segments are formed integrally with the upstream shroud, and the downstream blade segments are formed integrally with the downstream shroud and the hub.

In this structure, because the upstream blade segments formed integrally with the upstream shroud and the downstream blade segments formed integrally with the downstream shroud and the hub are bonded at the bonding surface, the impeller has smaller unremoved portions than an impeller fabricated by machining using a machining tool, thus inhibiting disruption of the fluid flow through the impeller.

In addition, because the upstream blade segments are formed integrally with the upstream shroud and the downstream blade segments are formed integrally with the downstream shroud and the hub, sufficient strength is ensured in regions where a high stress occurs as the impeller is rotated, thus preventing damage to the impeller.

For example, as the impeller is rotated, a high stress occurs in regions near the upstream ends of the boundary regions between the downstream blade segments and the hub, regions near the downstream ends thereof, and regions near the downstream ends of the boundary regions between the downstream blade segments and the downstream shroud. In these regions, sufficient strength is ensured by integrally forming the downstream blade segments, the downstream shroud, and the hub, rather than bonding the impeller blades and the shroud, thus preventing damage to the impeller.

In the first aspect of the present invention, preferably, the upstream blade segments are formed integrally with the shroud, and the downstream blade segments are formed integrally with the hub.

In this structure, because the upstream blade segments formed integrally with the shroud and the downstream blade segments formed integrally with the hub are bonded at the bonding surface, the impeller has smaller unremoved portions than an impeller fabricated by machining using a machining tool, thus inhibiting disruption of the fluid flow through the impeller.

In addition, because the upstream blade segments are formed integrally with the shroud and the downstream blade segments are formed integrally with the hub, sufficient strength is ensured in regions where a high stress occurs as the impeller is rotated, thus preventing damage to the impeller.

For example, as the impeller is rotated, a high stress occurs in regions near the downstream ends of the boundary regions between the upstream blade segments and the shroud. In these regions, sufficient strength is ensured by integrally forming the upstream blade segments and the shroud, rather than bonding the impeller blades and the shroud, thus preventing damage to the impeller.

Similarly, as the impeller is rotated, a high stress occurs in regions near the upstream ends of the boundary regions between the downstream blade segments and the hub and regions near the downstream ends thereof. In these regions, sufficient strength is ensured by integrally forming the downstream blade segments and the hub, rather than bonding the impeller blades and the shroud, thus preventing damage to the impeller.

A compressor according to a second aspect of the present invention includes the impeller according to the above first aspect.

In this structure, because the impeller according to the above first aspect is provided, disruption of the fluid flow through the impeller is inhibited.

In addition, sufficient strength is ensured in regions where a high stress occurs as the impeller is rotated, thus preventing damage to the impeller. Furthermore, the impeller can be fabricated with higher precision At the same time, a bonding failure can be prevented at the bonding surface of the impeller.

A method for producing an impeller according to a third aspect of the present invention includes a forming step of forming an upstream part including upstream blade segments, disposed upstream along a fluid flow, of impeller blades divided at a dividing surface extending in a direction substantially perpendicular to an axis of rotation of a hub and at least a portion of a shroud and a downstream part including downstream blade segments, disposed downstream, of the impeller blades divided at the dividing surface and at least a portion of the hub; and a bonding step of placing the downstream part with the dividing surface substantially horizontal and bonding the upstream part and the downstream part at the dividing surface.

In this structure, because the upstream part integrally constituted by the upstream blade segments and at least a portion of the shroud and the downstream part integrally constituted by the downstream blade segments and at least a portion of the hub are formed and are then bonded, the impeller has smaller unremoved portions than an impeller fabricated by machining using a machining tool, thus inhibiting disruption of the fluid flow through the impeller.

In addition, because the upstream blade segments are formed integrally with at least a portion of the shroud and the downstream blade segments are formed integrally with at least a portion of the hub, sufficient strength is ensured in regions of the upstream and downstream parts where a high stress occurs as the impeller is rotated, thus preventing damage to the impeller.

Furthermore, because the upstream part and the downstream part can be fabricated with higher precision than in a method in which impeller blades and a shroud are bonded, the impeller having the two parts bonded can be fabricated with higher precision.

At the same time, because the downstream part is placed with the dividing surface substantially horizontal before the upstream part and the downstream part are bonded, a bonding failure can be prevented at the dividing surface.

Advantageous Effects of Invention

The impeller, the compressor, and the method for producing an impeller of the present invention provide the advantage of improved performance because the impeller can be fabricated with higher precision, thus inhibiting disruption of the fluid flow through the impeller.

Also provided is the advantage of improved reliability because sufficient strength is ensured in regions where a high stress occurs as the impeller is rotated, thus preventing damage to the impeller, and also because a bonding failure is prevented at the bonding surface of the impeller.

DESCRIPTION OF EMBODIMENTS

First Embodiment

A compressor according to a first embodiment of the present invention will be described below with reference to FIGS. 1 to 4.

Figure 1:
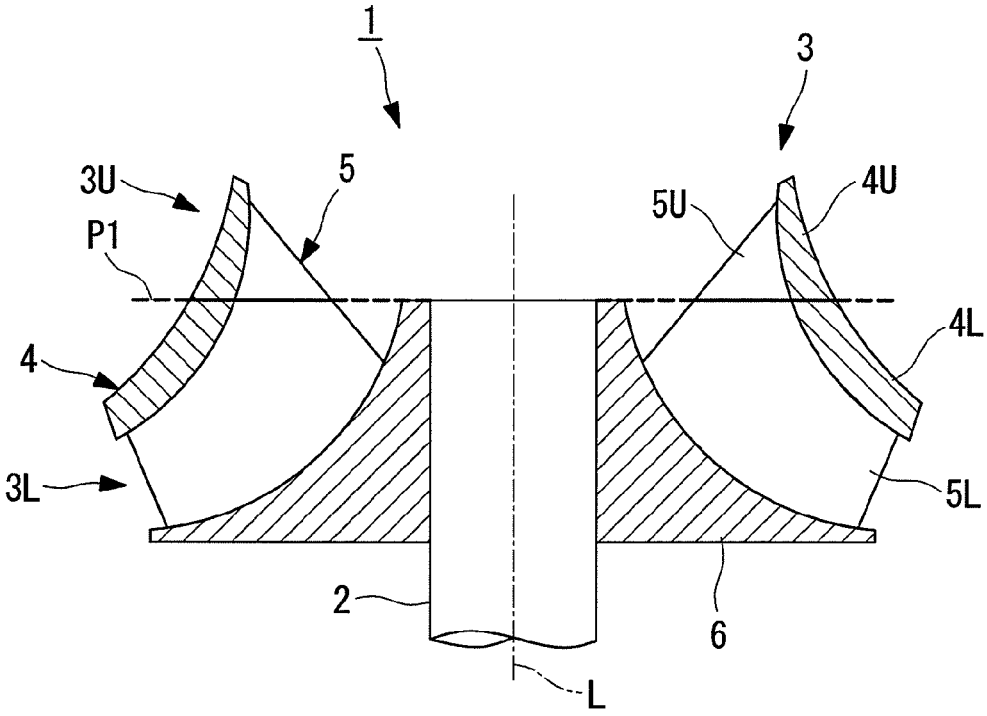
FIG. 1 is a schematic diagram illustrating, in outline, the structure of a compressor according to a first embodiment of the present invention.

FIG. 1 is a schematic diagram illustrating, in outline, the structure of the compressor of this embodiment.

In this embodiment, the case where the compressor of the present invention is applied to a centrifugal compressor for pumping a process gas (fluid) in a chemical plant will be described, although the compressor is not limited to a centrifugal compressor and may instead be applied to a mixed flow compressor or a compressor used for another application; that is, the type of compressor is not particularly limited.

As shown in FIG. 1, the centrifugal compressor (compressor) 1 pumps a fluid taken in from the upstream side (upper side in FIG. 1) to the downstream side (lateral direction in FIG. 1).

As shown in FIG. 1, the centrifugal compressor 1 includes a rotating shaft 2 and an impeller 3.

As shown in FIG. 1, the rotating shaft 2 is a substantially cylindrical member supported rotatably about an axis of rotation L and transmits an externally transmitted torque to the impeller 3.

Figure 2:
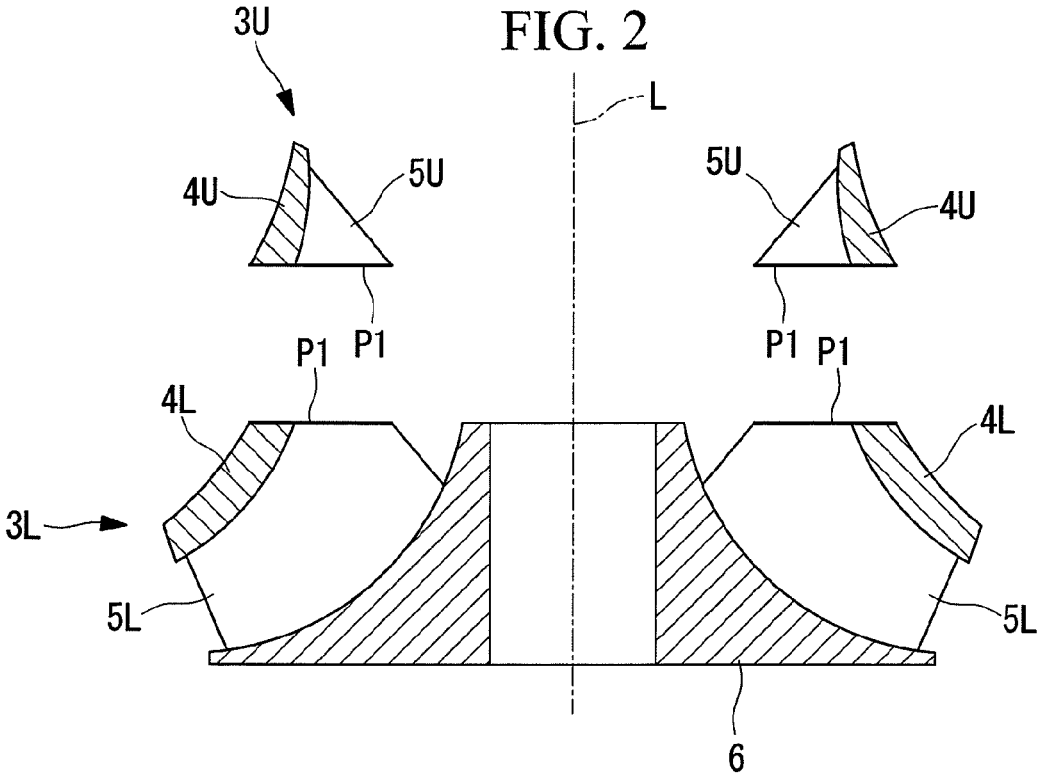
FIG. 2 is a schematic diagram illustrating the structures of upstream and downstream parts of an impeller in FIG. 1.

FIG. 2 is a schematic diagram illustrating the structures of upstream and downstream parts of the impeller 3 in FIG. 1.

As shown in FIGS. 1 and 2, the impeller 3 is rotated about the axis of rotation L by the rotating shaft 2 and, as it is rotated, it takes in a fluid from the upstream side and discharges the fluid to the downstream side.

The impeller 3 includes an upstream part 3U and a downstream part 3L divided at a dividing surface (bonding surface) P1.

The dividing surface P1 is a surface extending in a direction substantially perpendicular to the axis of rotation L and is a surface at which the impeller 3 is divided into the upstream part 3U and the downstream part 3L and also at which the upstream part 3U and the downstream part 3L are bonded.

As shown in FIGS. 1 and 2, the dividing surface P1 may be a flat surface or a conical surface having the axis of rotation L as the axis thereof and is not particularly limited.

If the dividing surface P1 is a conical surface, the dividing surface P1 is inclined to such an extent that a melted bonding material used for the upstream part 3U and the downstream part 3L does not flow downward when the axis of rotation L is oriented substantially vertically.

As shown in FIG. 1, the upstream part 3U is bonded to the downstream part 3L at the dividing surface P1 to constitute the impeller 3.

The upstream part 30 includes an upstream shroud 4U and upstream blade segments 5U.

As shown in FIG. 1, the upstream shroud 4U is an upstream segment (upper segment in FIG. 1) of a shroud 4 divided in two at the dividing surface P1 and is bonded to a downstream shroud 4L at the dividing surface P1 to constitute the shroud 4.

In addition, the upstream shroud 4U integrally constitutes the upstream part 3U, together with the upstream blade segments 5U.

As shown in FIG. 1, the shroud 4 is a cylindrical member whose diameter increases from the upstream to downstream sides or an annular plate-like member inclined toward a hub 6 so as to extend radially outward. In addition, the shroud 4 joins the tips of a plurality of impeller blades 5.

The shape of the shroud 4 may be a known shape and is not particularly limited.

As shown in FIG. 1, the upstream blade segments 5U are upstream segments of the impeller blades 5 divided in two at the dividing surface P1 and are bonded to downstream blade segments 5L at the dividing surface P1 to constitute the impeller blades 5. In addition, the upstream blade segments 5U integrally constitute the upstream part 3U, together with the upstream shroud 4U.

As shown in FIG. 1, the impeller blades 5 are blades extending radially outward from the outer circumferential surface of the hub 6 and arranged at regular intervals circumferentially about the axis of rotation L.

The shape of the impeller blades 5 may be a known shape and is not particularly limited.

As shown in FIG. 1, the downstream part 3L is bonded to the upstream part 3U at the dividing surface P1 to constitute the impeller 3.

The downstream part 3L includes the downstream shroud 4L, the downstream blade segments 5L, and the hub 6.

As shown in FIG. 1, the downstream shroud 4L is the downstream segment (lower segment in FIG. 1) of the shroud 4 divided in two at the dividing surface P1 and is bonded to the upstream shroud 4U at the dividing surface P1 to constitute the shroud 4.

In addition, the downstream shroud 4L integrally constitutes the downstream part 3L, together with the downstream blade segments 5L and the hub 6.

As shown in FIG. 1, the downstream blade segments 5L are the downstream segments of the impeller blades 5 divided in two at the dividing surface P1 and are bonded to the upstream blade segments 5U at the dividing surface P1 to constitute the impeller blades 5.

In addition, the downstream blade segments 5L integrally constitute the downstream part 3L, together with the downstream shroud 4L and the hub 6.

As shown in FIG. 1, the hub 6 is rotatably supported by the rotating shaft 2 and is formed in a substantially conical shape whose diameter increases from the upstream to downstream sides along a fluid flow. The impeller blades 5 are disposed on the outer circumferential surface of the hub 6 so as to extend radially outward.

Here, regions where a high stress occurs as the impeller 3 is rotated will be described.

Figure 3:
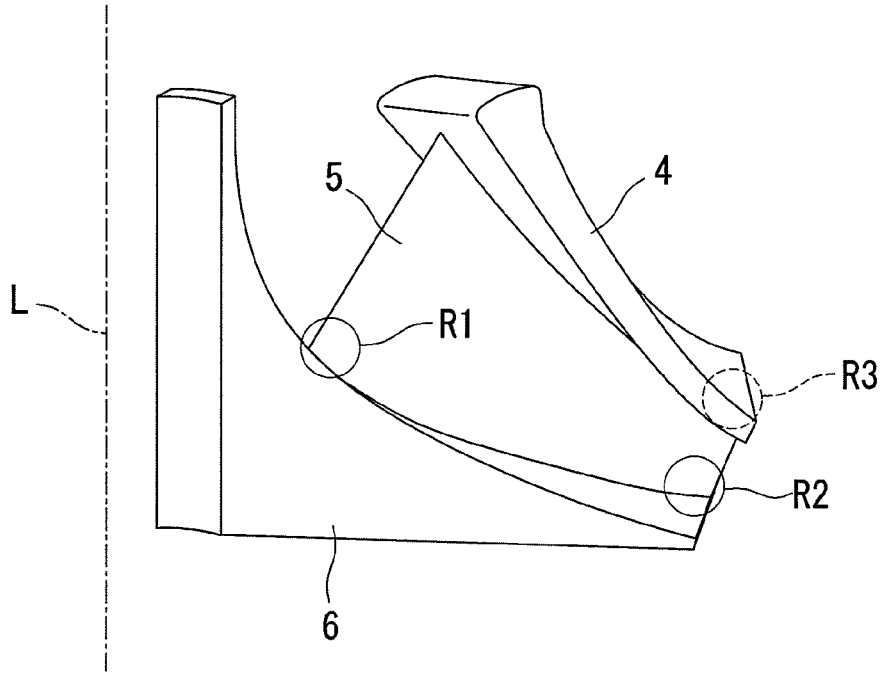
FIG. 3 is a partial perspective view of the impeller, illustrating regions where a high stress occurs as the impeller is rotated.
Figure 4:
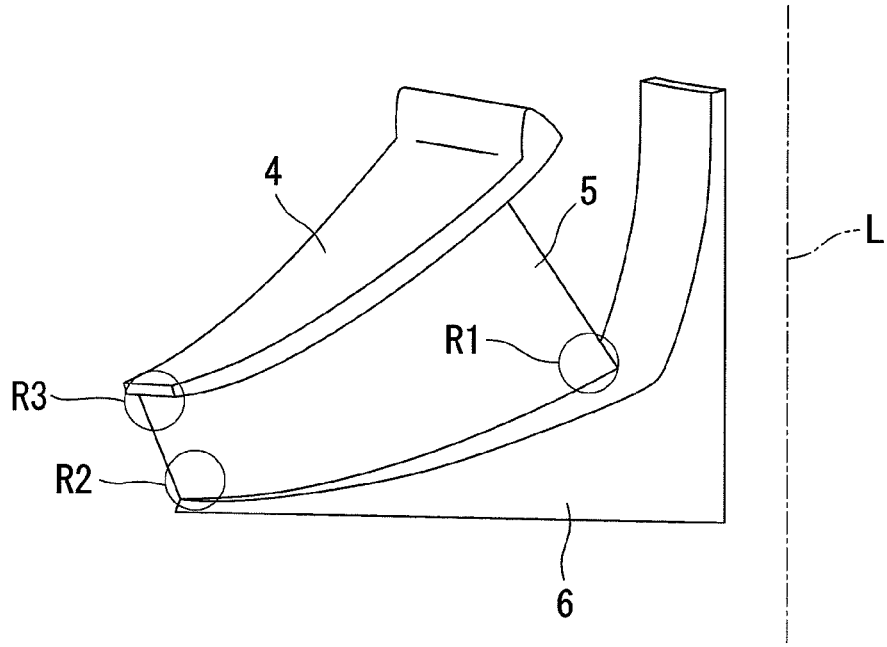
FIG. 4 is a partial perspective view of the impeller, illustrating regions where a high stress occurs as the impeller is rotated.

FIGS. 3 and 4 are partial perspective views of the impeller 3, illustrating regions where a high stress occurs as the impeller 3 is rotated.

As shown in FIGS. 3 and 4, as the impeller 3 is rotated, a high stress occurs in high-stress regions R1 near the upstream ends of the boundary regions between the downstream blade segments 5L and the hub 6, high-stress regions R2 near the downstream ends thereof, and high-stress regions R3 near the downstream ends of the boundary regions between the downstream blade segments 5L and the downstream shroud 4L.

In this embodiment, as shown in FIGS. 1 and 2, the impeller 3 is divided into the upstream part 3U and the downstream part 3L at the dividing surface P1. Accordingly, the above high-stress regions R1, R2, and R3 are associated with the downstream part 3L, which is integrally formed.

Next, a method for producing the impeller 3 of this embodiment will be described.

As shown in FIG. 2, first, the upstream part 3U and the downstream part 3L of the impeller 3 are separately formed (forming step).

The method used for forming the upstream part 3U and the downstream part 3L may be a known method such as casting, machining, or electrical discharge machining and is not particularly limited.

Subsequently, as shown in FIG. 1, the upstream part 3U and the downstream part 3L formed separately are bonded at the dividing surface P1, thus producing the impeller 3 (bonding step).

In this embodiment, the case where the upstream part 3U and the downstream part 3L are bonded at the dividing surface P1 by diffusion bonding will be described.

To bond the upstream part 3U and the downstream part 3L, the downstream shroud 4L is placed with the axis of rotation L substantially vertical, in other words, with the dividing surface P1 substantially horizontal, and a bonding material is then applied over the dividing surface P1.

Subsequently, as shown in FIG. 1, the upstream part 3U is placed on the downstream part 3L, and diffusion bonding is performed by placing the upstream part 3U and the downstream part 3L in a high-temperature environment such as the interior of a furnace.

The bonding at the dividing surface P1 may be diffusion bonding, as described above, or may be brazing or welding and is not particularly limited.

In addition, the diffusion bonding is not limited to solid-phase diffusion bonding and may instead be liquid-phase diffusion bonding.

Next, the operation of the centrifugal compressor 1 having the structure described above will be described.

In the centrifugal compressor 1, as shown in FIG. 1, the impeller 3 is rotated by the rotating shaft 2 to take a fluid from the upstream side (upper side in FIG. 1) into the space between the hub 6 and the shroud 4, in other words, the space in which the impeller blades 5 are disposed.

The intake fluid is then transferred to the downstream side (lateral direction in FIG. 1) along the wall surfaces of the hub 6 and the shroud 4 by the impeller blades 5. The transferred fluid is discharged from the centrifugal compressor 1 after the kinetic energy thereof is partially converted to pressure by diffusers (not shown) of the centrifugal compressor 1.

In the structure described above, because the upstream part 3U integrally constituted by the upstream blade segments 5U and the upstream shroud 4U and the downstream part 3L integrally constituted by the downstream blade segments 5L, the downstream shroud 4L, and the hub 6 are bonded at the dividing surface P1, the impeller 3 has smaller unremoved portions than an impeller fabricated by machining using a machining tool. This inhibits disruption of the fluid flow through the impeller 3, thus improving the performance of the centrifugal compressor 1.

That is, the upstream part 3U and the downstream part 3L have smaller unremoved portions than in the case where the entire impeller 3 is integrally formed because they interfere with a machining tool over a narrower region. Accordingly, the impeller 3 having the upstream part 3U and the downstream part 3L bonded at the dividing surface P1 has smaller unremoved portions.

In addition, because the upstream blade segments 5U and the upstream shroud 4U are integrally formed and the downstream blade segments 5L, the downstream shroud 4L, and the hub 6 are integrally formed, sufficient strength is ensured in regions where a high stress occurs as the impeller 3 is rotated. This prevents damage to the impeller 3, thus improving the reliability of the centrifugal compressor 1.

Specifically, as the impeller 3 is rotated, a high stress occurs in the high-stress regions R1 near the upstream ends of the boundary regions between the downstream blade segments 5L and the hub 6, the high-stress regions R2 near the downstream ends thereof, and the high-stress regions R3 near the downstream ends of the boundary regions between the downstream blade segments 5L and the downstream shroud 4L. In these regions, sufficient strength can be ensured by integrally forming the downstream blade segments 5L, the downstream shroud 4L, and the hub 6, rather than bonding the impeller blades 5 and the shroud 4, thus preventing damage to the impeller 3.

Furthermore, because the upstream part 3U and the downstream part 3L can be fabricated with higher precision than in a method in which impeller blades and a shroud are bonded, the impeller 3 having the two parts bonded and the centrifugal compressor 1 including the impeller 3 can be fabricated with higher precision. This improves the reliability and performance of the impeller 3 and the centrifugal compressor 1.

At the same time, because the downstream part 3L is placed with the dividing surface P1 substantially horizontal before the upstream part 3U and the downstream part 3L are bonded, a bonding failure can be prevented at the dividing surface P1.

Specifically, in this embodiment, which employs diffusion bonding, the downstream part 3L is placed with the bonding surface, described above, substantially horizontal before the upstream part 3U and the downstream part 3L are bonded, so that the bonding material used for bonding cannot easily flow downward. In other words, the bonding material is present substantially uniformly over the entire dividing surface P1, thus preventing a bonding failure due to insufficient bonding material.

Second Embodiment

Next, a second embodiment of the present invention will be described with reference to FIGS. 5 and 6.

The basic structure of the compressor of this embodiment is similar to that of the first embodiment; however, they differ in the position of the dividing surface. In this embodiment, therefore, the structures of the dividing surface and the upstream and downstream parts will be described using FIGS. 5 and 6, and a description of the other elements, etc. will be omitted.

Figure 5:
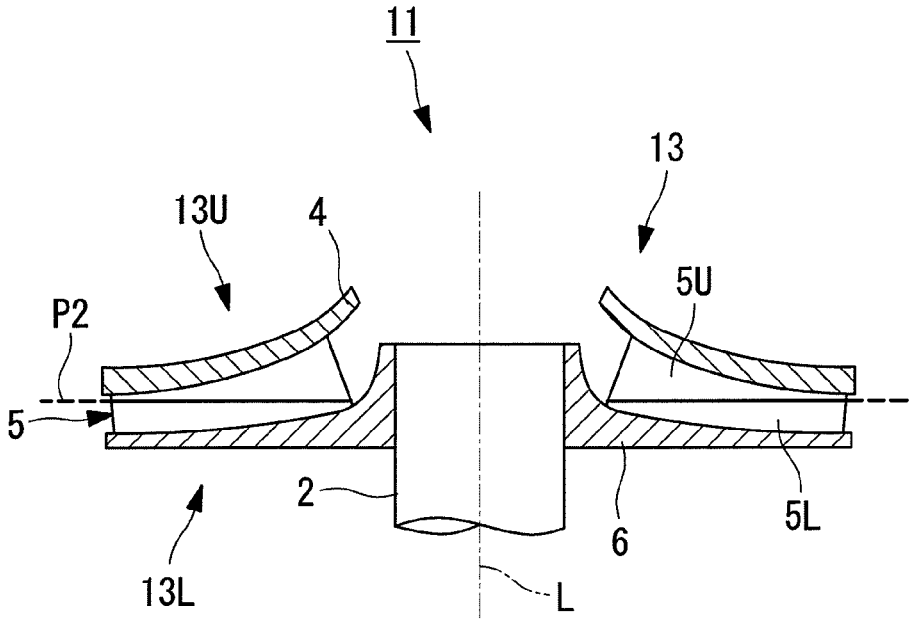
FIG. 5 is a schematic diagram illustrating the structure of an impeller of a compressor according to a second embodiment of the present invention.

FIG. 5 is a schematic diagram illustrating the structure of the impeller of the compressor according to this embodiment. FIG. 6 is a schematic diagram illustrating the structures of the upstream and downstream parts of the impeller in FIG. 5.

The same elements as those in the first embodiment are denoted by the same reference signs, and a description thereof will be omitted.

Figure 6:
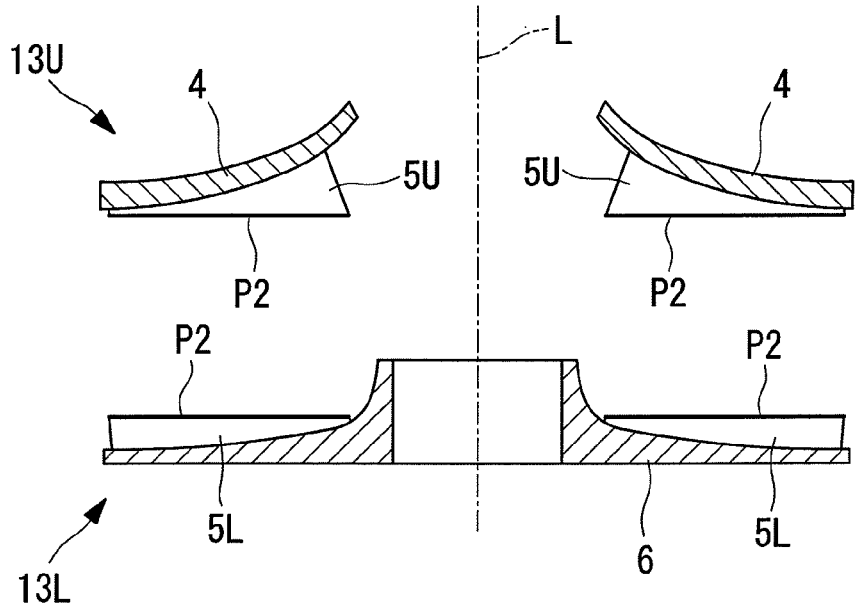
FIG. 6 is a schematic diagram illustrating the structures of upstream and downstream parts of the impeller in FIG. 5.

As shown in FIGS. 5 and 6, an impeller 13 of a centrifugal compressor (compressor) 11 of this embodiment includes an upstream part 13U and a downstream part 23L divided at a dividing surface (bonding surface) P2.

As shown in FIG. 6, the upstream part 13U is bonded to the downstream part 13L at the dividing surface P2 to constitute the impeller 13.

The upstream part 13U includes a shroud 4 and upstream blade segments 50.

As shown in FIG. 6, the downstream part 13L is bonded to the upstream part 13U at the dividing surface P2 to constitute the impeller 13.

The downstream part 13L includes the downstream blade segments 5L and the hub 6.

Next, a method for producing the impeller 13 of this embodiment will be described.

As shown in FIG. 6, first, the upstream part 13U and the downstream part 13L of the impeller 13 are separately formed (forming step).

The method used for forming the upstream part 13U and the downstream part 13L may be a known method such as casting or machining and is not particularly limited.

Subsequently, as shown in FIG. 5, the upstream part 13U and the downstream part 13L formed separately are bonded at the dividing surface P2, thus producing the impeller 13 (bonding step).

The bonding at the dividing surface P2 may be diffusion bonding, as described above, or may be brazing or welding and is not particularly limited.

In addition, the diffusion bonding is not limited to solid-phase diffusion bonding and may instead be liquid-phase diffusion bonding.

In the structure described above, because the upstream part 13U integrally constituted by the upstream blade segments 5U and the shroud 4 and the downstream part 13L integrally constituted by the downstream blade segments 5L and the hub 6 are bonded at the dividing surface P2, the impeller 13 has smaller unremoved portions than an impeller fabricated by machining using a machining tool. This inhibits disruption of the fluid flow through the impeller 13, thus improving the performance of the centrifugal compressor 11.

In addition, because the upstream blade segments 5U and the shroud 4 are integrally formed and the downstream blade segments 5L and the hub 6 are integrally formed, sufficient strength is ensured in regions where a high stress occurs as the impeller 13 is rotated, thus preventing damage to the impeller 13.

Specifically, as the impeller 13 is rotated, a high stress occurs in the high-stress regions R3 near the downstream ends of the boundary regions between the upstream blade segments 5U and the shroud 4. In these regions, sufficient strength is ensured by integrally forming the upstream blade segments 5U and the shroud 4, rather than bonding the impeller blades 5 and the shroud 4, thus preventing damage to the impeller 13.

Similarly, as the impeller 13 is rotated, a high stress occurs in the high-stress regions R1 near the upstream ends of the boundary regions between the downstream blade segments 5L and the hub 6 and the high-stress regions R2 near the downstream ends thereof. In these regions, sufficient strength is ensured by integrally forming the downstream blade segments 5L and the hub 6, rather than bonding the impeller blades 5 and the shroud 4, thus preventing damage to the impeller 13.

Third Embodiment

Next, a third embodiment of the present invention will be described with reference to FIGS. 7 and 8.

The basic structure of the compressor of this embodiment is similar to that of the first embodiment; however, they differ in the position of the dividing surface. In this embodiment, therefore, the structures of the dividing surface and the upstream and downstream parts will be described using FIGS. 7 and 8, and a description of the other elements, etc. will be omitted.

Figure 7:
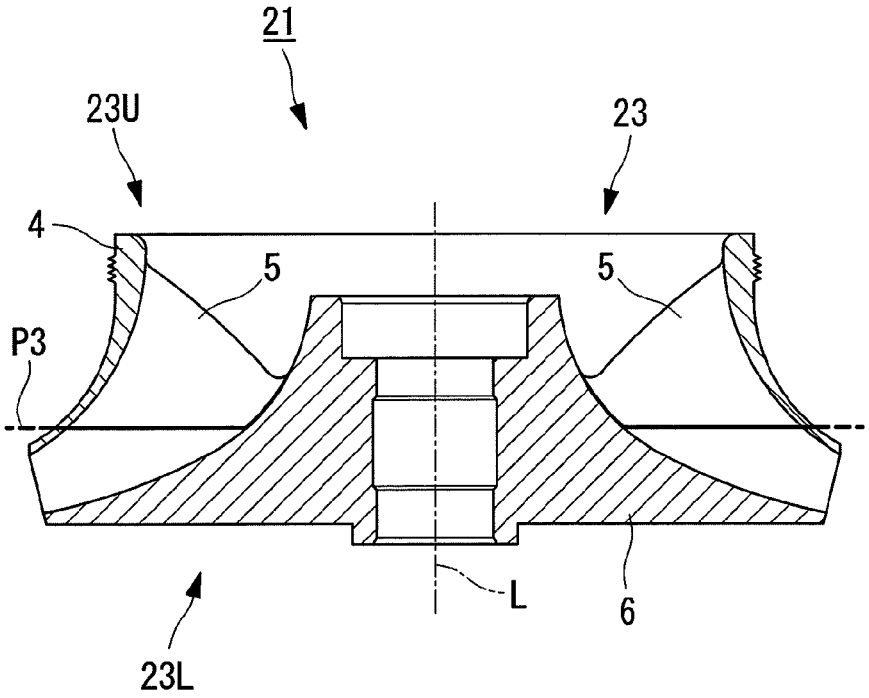
FIG. 7 is a schematic diagram illustrating the structure of an impeller of a compressor according to a third embodiment of the present invention.

FIG. 7 is a schematic diagram illustrating the structure of the impeller of the compressor according to this embodiment. FIG. 8 is a schematic diagram illustrating the structures of the upstream and downstream parts of the impeller in FIG. 7.

The same elements as those in the first embodiment are denoted by the same reference signs, and a description thereof will be omitted.

Figure 8:
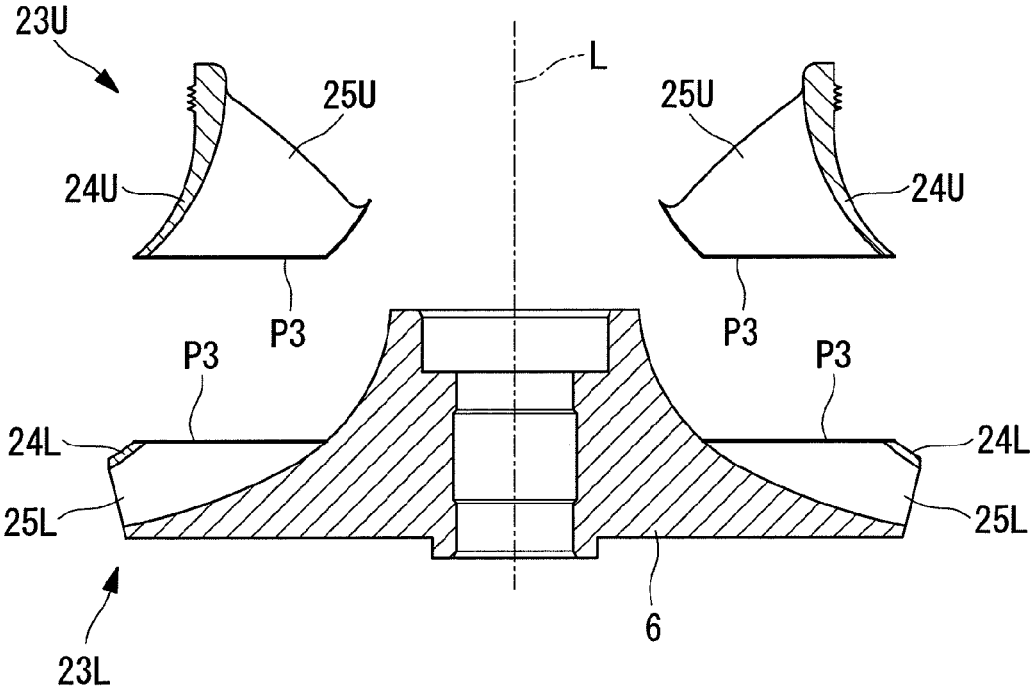
FIG. 8 is a schematic diagram illustrating the structures of upstream and downstream parts of the impeller in FIG. 7.

As shown in FIGS. 7 and 8, an impeller 23 of a centrifugal compressor (compressor) 21 of this embodiment includes an upstream part 23U and a downstream part 23L divided at a dividing surface (bonding surface) P3.

As shown in FIG. 8, the upstream part 23U is bonded to the downstream part 23L at the dividing surface P3 to constitute the impeller 23.

The upstream part 23U includes an upstream shroud 24U and upstream blade segments 25U.

As shown in FIG. 8, the upstream shroud 24U is the upstream segment (upper segment in FIG. 8) of the shroud 4 divided in two at the dividing surface P3 and is bonded to a downstream shroud 24L at the dividing surface P3 to constitute the shroud 4.

As shown in FIG. 8, the upstream blade segments 25U are the upstream segments of the impeller blades 5 divided in two at the dividing surface P3. Accordingly, the upstream blade segments 5U have portions bonded to the downstream blade segments 25L and portions bonded to the hub 6.

In addition, the upstream blade segments 25U integrally constitute the upstream part 23U, together with the upstream shroud 24U.

As shown in FIG. 8, the downstream part 23L is bonded to the upstream part 23U at the dividing surface P3 to constitute the impeller 23.

The downstream part 23L includes the downstream shroud 24L, the downstream blade segments 25L, and the hub 6.

As shown in FIG. 8, the downstream shroud 24L is the downstream segment (lower segment in FIG. 8) of the shroud 4 divided in two at the dividing surface P3 and is bonded to the upstream shroud 24U at the dividing surface P3 to constitute the shroud 4.

As shown in FIG. 8, the downstream blade segments 25L are the downstream segments of the impeller blades 5 divided in two at the dividing surface P3 and are bonded to the upstream blade segments 25U at the dividing surface P3 to constitute the impeller blades 5.

In addition, the downstream blade segments 25L integrally constitute the downstream part 23U, together with the downstream shroud 24L and the hub 6.

As shown in FIG. 7, the dividing surface P3 is a surface constituted by a portion extending in a direction substantially perpendicular to the axis of rotation L and dividing the impeller 23 and the shroud 4 and a portion extending radially inward so as to be inclined upward (upward in FIG. 7) along the bonding surface between the hub 6 and the impeller 23.

In other words, the dividing surface P1 is also the surface at which the upstream part 23U and the downstream part 23L are bonded.

Next, a method for producing the impeller 23 of this embodiment will be described.

As shown in FIG. 8, first, the upstream part 23U and the downstream part 23L of the impeller 23 are separately formed (forming step).

The method used for forming the upstream part 23U and the downstream part 23L may be a known method such as casting, machining, or electrical discharge machining and is not particularly limited.

Subsequently, as shown in FIG. 7, the upstream part 23U and the downstream part 23L formed separately are bonded at the dividing surface P3, thus producing the impeller 23 (bonding step).

Specifically, the bonding is performed by brazing in the portion of the dividing surface P3 where the upstream blade segments 25U and the downstream blade segments 25L are bonded.

In other words, the upstream part 23U and the downstream part 23L are bonded by brazing in the substantially horizontal portion of the dividing surface P3, that is, the portion of the dividing surface P3 substantially perpendicular to the axis of rotation L.

On the other hand, the bonding is performed by welding in the portion of the dividing surface P3 where the upstream blade segments 25U and the hub 6 are bonded.

In other words, the upstream part 23U and the downstream part 23L are bonded by welding in the inclined portion of the dividing surface P1.

In the structure described above, the hub 6, which is integrally formed, has a higher strength than a segmented hub 6.

It is preferable that the hub 6 have a higher strength because force acts thereon as the centrifugal compressor 1 is operated.

Because the upstream part 23U and the downstream part 23L are bonded by brazing in the portion of the dividing surface P3 extending substantially horizontally, the brazing alloy can be prevented from leaking out, thus allowing stable bonding.

On the other hand, because the bonding is performed by welding in the inclined portion of the dividing surface P3, a bonding failure due to leakage of a brazing alloy can be prevented. In addition, because the welded joint is limited by providing the brazed joint, which permits high bonding precision, the upstream part 23U and the downstream part 23L can be bonded with high precision.

REFERENCE SIGNS LIST

1, 11, 21 centrifugal compressor (compressor)
3, 13, 23 impeller
3U, 13U, 23U upstream part
3L, 13L, 23L downstream part
4 shroud
4U, 24U upstream shroud
4L, 24L downstream shroud
5 impeller blade
5U, 25U upstream blade segment
5L, 25L downstream blade segment
6 hub
P1, P2, P3 dividing surface (bonding surface)
L axis of rotation

The invention claimed is:

1. An impeller comprising:

a hub which is supported rotatably about an axis of rotation and whose diameter increases from upstream to downstream sides along a fluid flow;

a plurality of impeller blades extending radially outward from an outer circumferential surface of the hub; and a shroud formed in a cylindrical shape whose diameter increases from the upstream to downstream sides along the fluid flow and joining outer circumferential ends of the plurality of impeller blades, wherein the impeller blades comprise upstream blade segments and downstream blade segments bonded by brazing at a bonding surface extending in a direction substantially perpendicular to the axis of rotation, wherein the upstream blade segments are integral with a portion of the shroud and are not integral with a portion of the hub and are welded to the hub at an inclined surface formed by the diameter increase of the hub, and wherein the downstream blade segments are integral with at least a portion of the hub.

2. The impeller according to claim 1, wherein the shroud comprises an upstream shroud and a downstream shroud bonded at the bonding surface; and wherein the upstream blade segments are formed integrally with the upstream shroud, and the downstream blade segments are formed integrally with the downstream shroud and the hub.

3. The impeller according to claim 1, wherein the upstream blade segments are formed integrally with the shroud, and the downstream blade segments are formed integrally with the hub.

4. A compressor comprising the impeller according to claim 1.

5. A method for producing an impeller, the method comprising:

a forming step of forming:

an upstream part which includes upstream blade segments, disposed upstream along a fluid flow, of impeller blades divided at a dividing surface extending in a direction substantially perpendicular to an axis of rotation of a hub whose diameter increases from upstream to downstream sides along the fluid flow and a portion of a shroud, and which does not include a portion of the hub; and a downstream part which includes downstream blade segments, disposed downstream, of the impeller blades divided at the dividing surface and at least a portion of the hub; and a bonding step of placing the downstream part with the dividing surface substantially horizontal, bonding the upstream blade segments and the downstream blade segments by brazing at the dividing surface, and bonding the upstream blade segments and the hub by welding at an inclined surface formed by the diameter increase of the hub.

6. A compressor comprising the impeller according to claim 2.

7. A compressor comprising the impeller according to claim 3.

* * * * *